US006311974B1

(12) United States Patent
Koga

(10) Patent No.: US 6,311,974 B1
(45) Date of Patent: Nov. 6, 2001

(54) GAMING MACHINE WITH STERILIZING LIGHT BEAM

(75) Inventor: Akira Koga, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/394,705

(22) Filed: Sep. 13, 1999

(30) Foreign Application Priority Data

Sep. 14, 1998 (JP) ..... 10-279446

(51) Int. Cl.[7] ..... A63F 9/24
(52) U.S. Cl. ..... 273/118 R; 463/20; 273/121 B
(58) Field of Search ..... 210/748; 273/121 B; 463/16, 20

(56) References Cited

FOREIGN PATENT DOCUMENTS

10057614 A * 3/1998 (JP) .

5-266298 A * 10/1993 (JP) ..... G07D/9/00

* cited by examiner

*Primary Examiner*—Valencia Martin-Wallace
*Assistant Examiner*—Julie Kasick
(74) *Attorney, Agent, or Firm*—Snider & Associates; Ronald R. Snider

(57) ABSTRACT

Light-emitting means for emitting a light beam for sterilizing a gaming medium is disposed in a gaming machine itself at a position where the light beam irradiates a stored gaming medium or a passing gaming medium, the light-emitting means being shielded from eyes of a player. In particular, the gaming machine is a ball-shooting gaming machine or a coin or medal gaming machine. Specifically, the light-emitting means is disposed at a position where the light beam irradiates a gaming medium flowing into storage means within the gaming machine or a gaming medium stored in the storage means. Specifically, the light-emitting means is disposed at a position where the light beam irradiates a gaming medium stored in a tray located outside the gaming machine. Preferably, the light beam is an ultraviolet ray. As a consequence, the antibacterial specification of the gaming machine becomes more effective, and an antibacterial specification is newly realized in the case of the coin or medal gaming machine.

26 Claims, 4 Drawing Sheets

GAMING MACHINE WITH STERILIZING LIGHT BEAM

RELATED APPLICATIONS

This application claims the priority of Japanese Patent Application No. 10-279446 filed on Sep. 14, 1998, which is incorporated herein by reference.

BACKGROUND OF THE INVENTION

1. Field of the Invention

The present invention relates to a gaming machine and, in particular, to an antibacterial gaming machine suitable as a coin or medal gaming machine such as a ball-shooting gaming machine like a pachinko machine or as a rotary drum type gaming machine.

2. Description of the Prior Art

Recently, various articles and apparatus have adopted antibacterial specifications. Among gaming machines, pachinko machines with antibacterial specifications, for example, have been proposed Japanese Unexamined Patent Publication No. 10-57614).

Currently, many of pachinko machines are managed as a unit of "territory," i.e., a group of about 10 to 20 machines; and pachinko balls, which are a gaming medium, are supplied, collected, and cleansed by this territory unit.

In the above-mentioned prior art, an ultraviolet irradiating device is disposed in the middle of a cleansing apparatus, where pachinko balls having surfaces coated with a titanium oxide photocatalyst are irradiated with ultraviolet rays so as to enhance their bactericidal effects, and then the pachinko balls are cleansed and further are subjected to sterilization with ozone.

The above-mentioned prior art concerning pachinko machines, however, necessitates pachinko balls coated with a titanium oxide photocatalyst, thus increasing their cost, and this coating has to be taken into account in each event of purchase, exchange, and the like. The apparatus itself is large and expensive. Further, since it requires cleansing, the cleansing liquid itself always has to be kept clean, thus making its management troublesome. Also, it incurs a cost therefor.

In the case of a centralized management system, pachinko balls reach their pachinko machines by way of long supply paths after leaving the cleansing apparatus, so as to be stored in their corresponding storage devices. The supply paths and storage devices usually lack a completely sealed structure and thus are exposed to dust, tobacco smoke, and the like in game arcades. Therefore, it is necessary to frequently clean these individual sections if a degree of cleanliness is to be maintained truly.

On the other hand, there are rotary drum type gaming machines, which are a medal gaming machine, as the so-called other leader of gaming machines, but no antibacterial apparatus such as the one mentioned above has yet been proposed therefor. Therefore, it is often heard that women are reluctant to touch medals in game arcades.

The above-mentioned prior art may be applied to such gaming machines. However, unlike the pachinko machines, the rotary drum type gaming machines often do not carry out centralized management of medals, which are their gaming medium, in general.

Therefore, the above-mentioned prior art cannot simply be applied to rotary drum type gaming machines which are not based on the centralized management system though being similarly categorized as gaming machines.

SUMMARY OF THE INVENTION

It is an object of the present invention to overcome the above-mentioned shortcomings of the prior art, to make antibacterial specifications more effective in gaming machines in general including pachinko machines and rotary drum type gaming machines, and to realize a new antibacterial specification in the rotary drum type gaming machines.

In the present invention, in order to attain the above-mentioned object, light-emitting means for emitting a light beam for sterilizing a gaming medium is disposed in the gaming machine itself at a position where the light beam irradiates a stored gaming medium or a passing gaming medium, the light-emitting means being shielded from eyes of a player.

Specifically, the present invention is applied to a ball-shooting gaming machine.

Specifically, the present invention is applied to a coin or medal gaming machine.

Specifically, the light-emitting means is disposed at a position where the light beam irradiates a gaming medium flowing into storage means within the gaming machine or a gaming medium stored in the storage means.

Specifically, the light-emitting means is disposed at a position where the light beam irradiates a gaming medium stored in a tray located outside the gaming machine.

Preferably, the light-emitting means is disposed within a housing of the gaming machine, and is turned off in synchronization with an opening action of all open/close panel of the housing of the gaming machine when the open/close panel is caused to open.

Preferably, the light beam is an ultraviolet ray.

DESCRIPTION OF THE PREFERRED EMBODIMENTS

Figure 1:
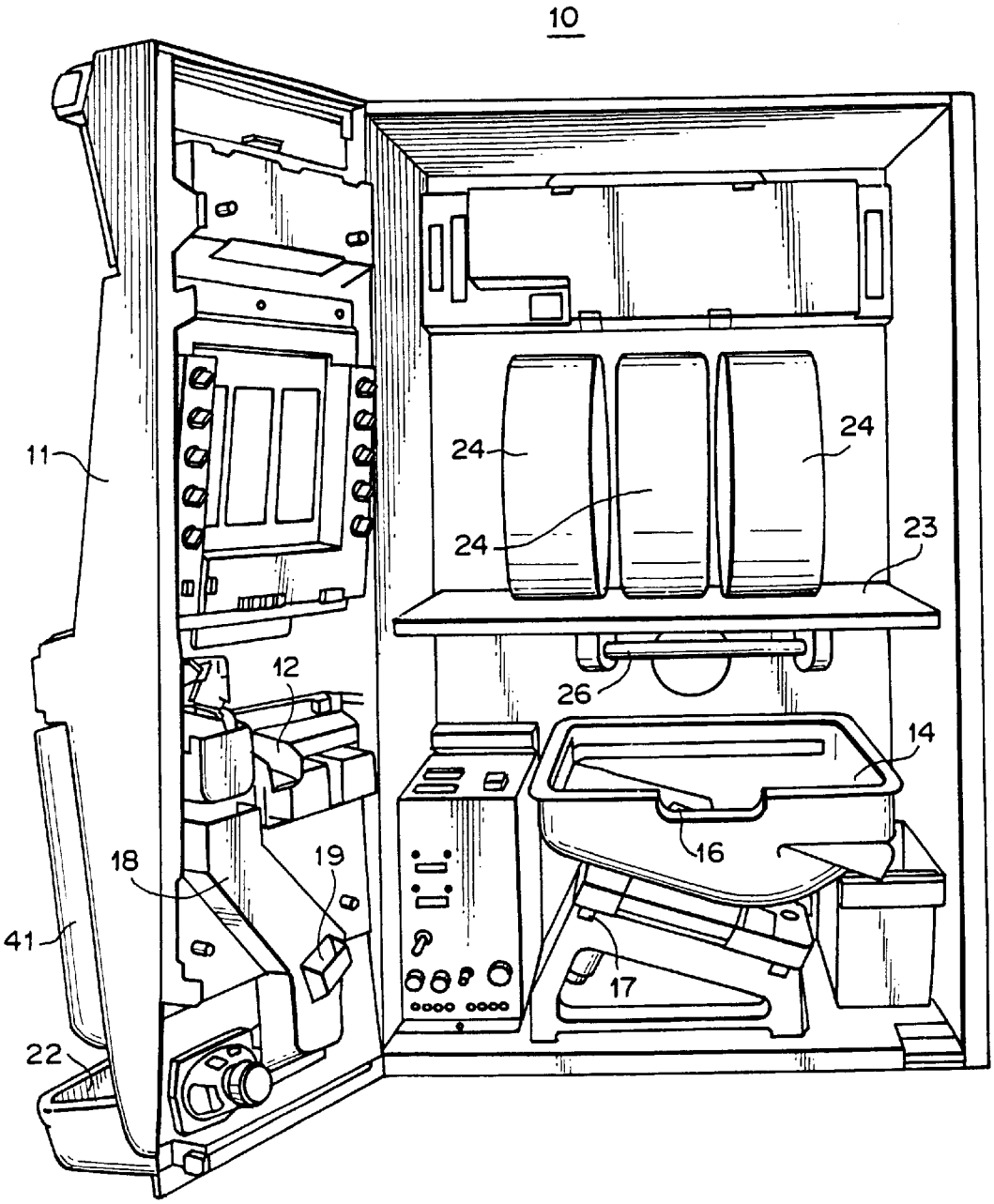
FIG. 1 is a perspective view of a pachislo machine 10 in accordance with a first embodiment of the present invention as seen from the front side thereof.

In the following, details of the present invention will be explained with reference to illustrated embodiments. FIG. 1 shows a rotary drum type gaming machine (hereinafter referred to as "pachislo machine") in accordance with a first embodiment. Depicted here is a state where a front door 11 is opened to the left side. The structure of a pachislo machine has already been well-known. Therefore, only the parts directly relating to the present invention will be explained without describing the other parts.

Figure 3:
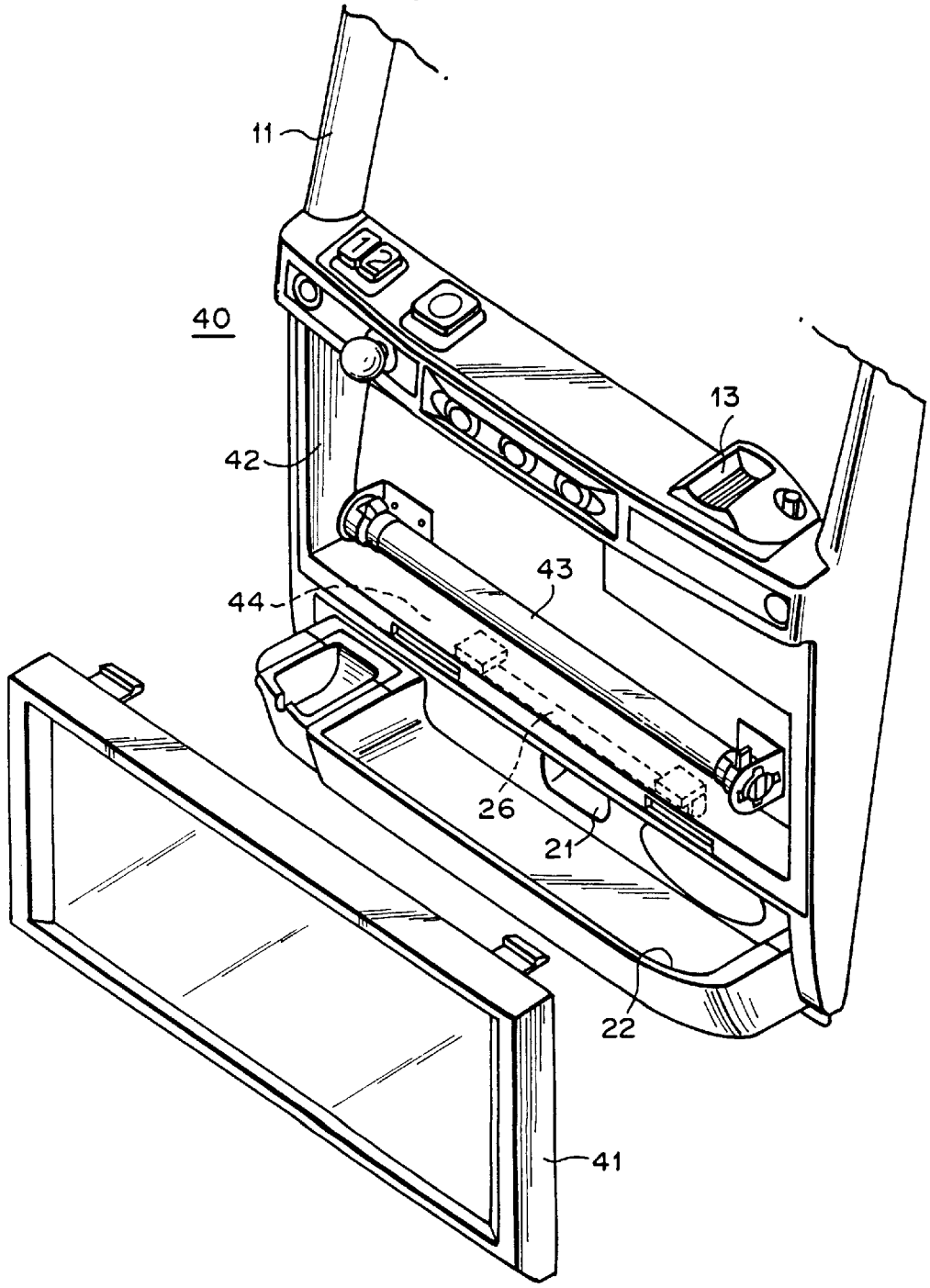
FIG. 3 is a perspective view showing the lower side of the front face of a pachislo machine 40 in accordance with a third embodiment of the present invention as seen from the upper right side in front thereof with a wainscot panel 41 being removed therefrom.

In FIG. 1, a medal inserted through an insertion slot 13 in FIG. 3 and sensed by an unshown counter passes through a chute 12, rolls down a slope 16 in front of the inside of a hopper 14, and drops into the hopper 14.

When a prize is won, then a number of medals corresponding to the contents of the prize are sent out from a medal outlet 17 by a sending mechanism disposed at the bottom part of the hopper 14. From a receiving slot 19 formed in the middle of a duct 18, the medals pass through the duct 18 and, by way of a payout slot 21 (FIG. 3), accumulate in a tray 22.

On a chassis 23 for a reel unit, individual reels 24 are mounted. Attached to the lower face of the chassis 23 is a bactericidal lamp 26 for emitting ultraviolet rays. It corresponds to the light-emitting means in claims.

While the pachislo machine 10 is in operation, the bactericidal lamp 26 is continuously lit. Here, an interlock (not illustrated) adapted to operate in synchronization with the front door 11 is provided, such that the bactericidal lamp 26 is turned off when the front door 11 is opened.

The front door 11 is not opened and closed so often, and is not opened for a long period of time. Also, the ultraviolet rays of a usual bactericidal lamp are not so strong as to immediately do serious harm to eyes if entering them. Therefore, it seems that the interlock can be omitted if a warning seal with such a message as "BACTERICIDAL LAMP IS ON. DON'T LOOK DIRECT!" is prepared with a noticeable color and stuck to a place which is easy to see, for example.

The bactericidal lamp 26 is disposed directly above the hopper 14. The ultraviolet rays emitted therefrom irradiate the medals flowing into the hopper 14, after sliding down the chute 12, and the medals staying in the hopper 14. The ultraviolet rays have a strong bactericidal power as a matter of course. Since the ultraviolet rays are continuously emitted, all the bacteria attached to the medals would die.

Also, the distance between the medal outlet 17 and the tray 22 is very short. As a consequence, the sterilized medals reach the tray 22 without hardly being soiled on their way, thereby being supplied to a player's hand.

Figure 2A:
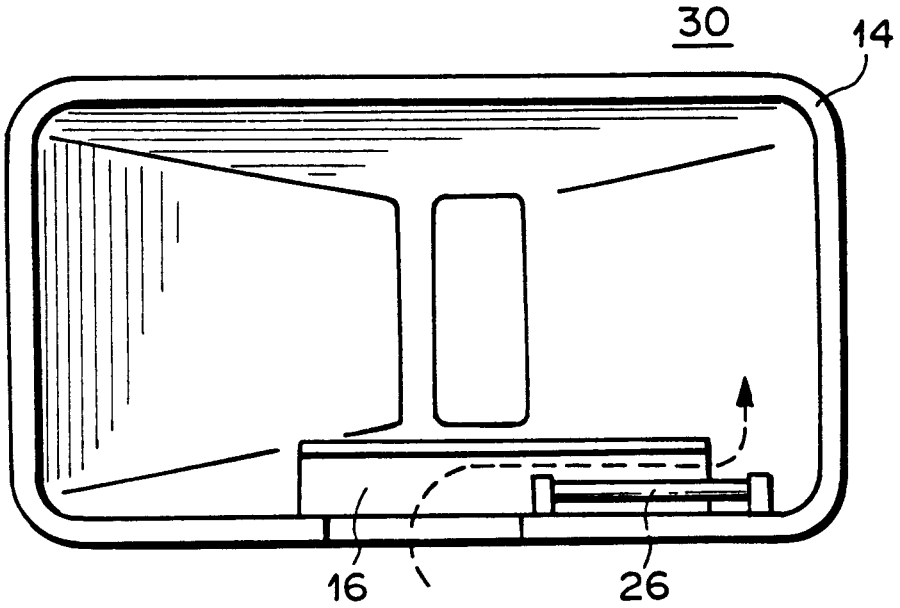
FIGS. 2A and 2B are a plan view and a perspective view seen from the back side of a hopper 14 taken out alone from a pachislo machine 30 in accordance with a second embodiment of the present invention, respectively.
Figure 2B:
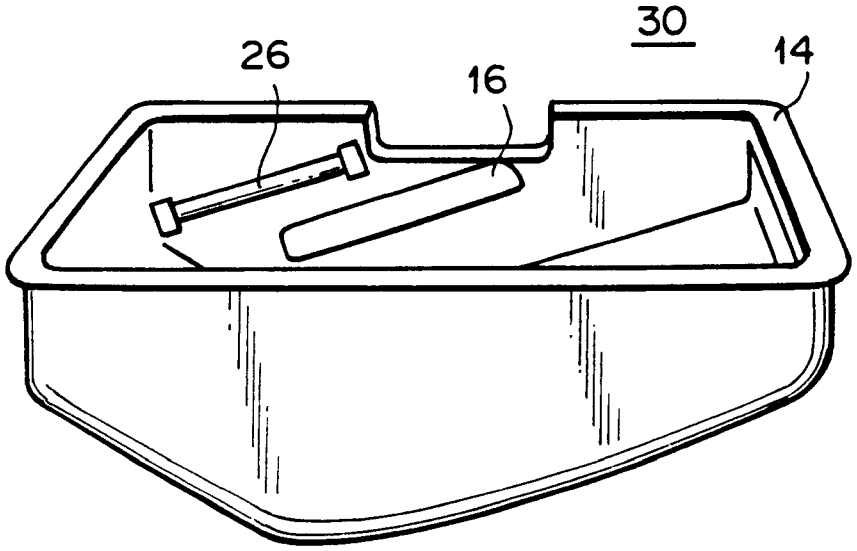

FIGS. 2A and 2B show the case of a pachislo machine 30 in accordance with a second embodiment. In the pachislo machine 30 in accordance with the second embodiment, the bactericidal lamp 26 is disposed within the hopper 14. FIGS. 2A and 2B show the hopper 14 taken out alone from the pachislo machine 30 in accordance with the second embodiment, illustrating a plan view and a perspective view seen from the back side of the pachislo machine, respectively. The other parts are the same as those in the pachislo machine 10 in accordance with the first embodiment and thus are not illustrated here.

The bactericidal lamp 26 is attached to a part immediately above the slope 16 where medals roll down. The ultraviolet rays emitted therefrom irradiate medals flowing into the hopper 14 in particular, and also irradiate medals staying in the hopper 14. As a consequence, the ultraviolet rays irradiate the rolling medals from various angles, whereby all the bacteria attached thereto would die.

The distance between the medal outlet 17 and the tray 22 is very short here as well. As a consequence, the sterilized medals reach the tray 22 without substantially being soiled on their way, thereby being supplied to a player's hand.

As a general rule, the bactericidal lamp 26 is also continuously lit while the pachislo machine 30 is in operation. Here, the bactericidal lamp 26 is disposed within the hopper 14. Therefore, the ultraviolet rays are not usually made incident on eyes of employees and the like when simply opening the front door 11. Also, as mentioned above, the front door 11 is not opened and closed so often, and is not opened for a long period of time. Consequently, it seems further unnecessary to provide an interlock adapted to operate in synchronization with the opening and closing of the front door 11 if the bactericidal lamp 26 is disposed at such a position as that in the pachislo machine 30 in the second embodiment.

Figure 4:
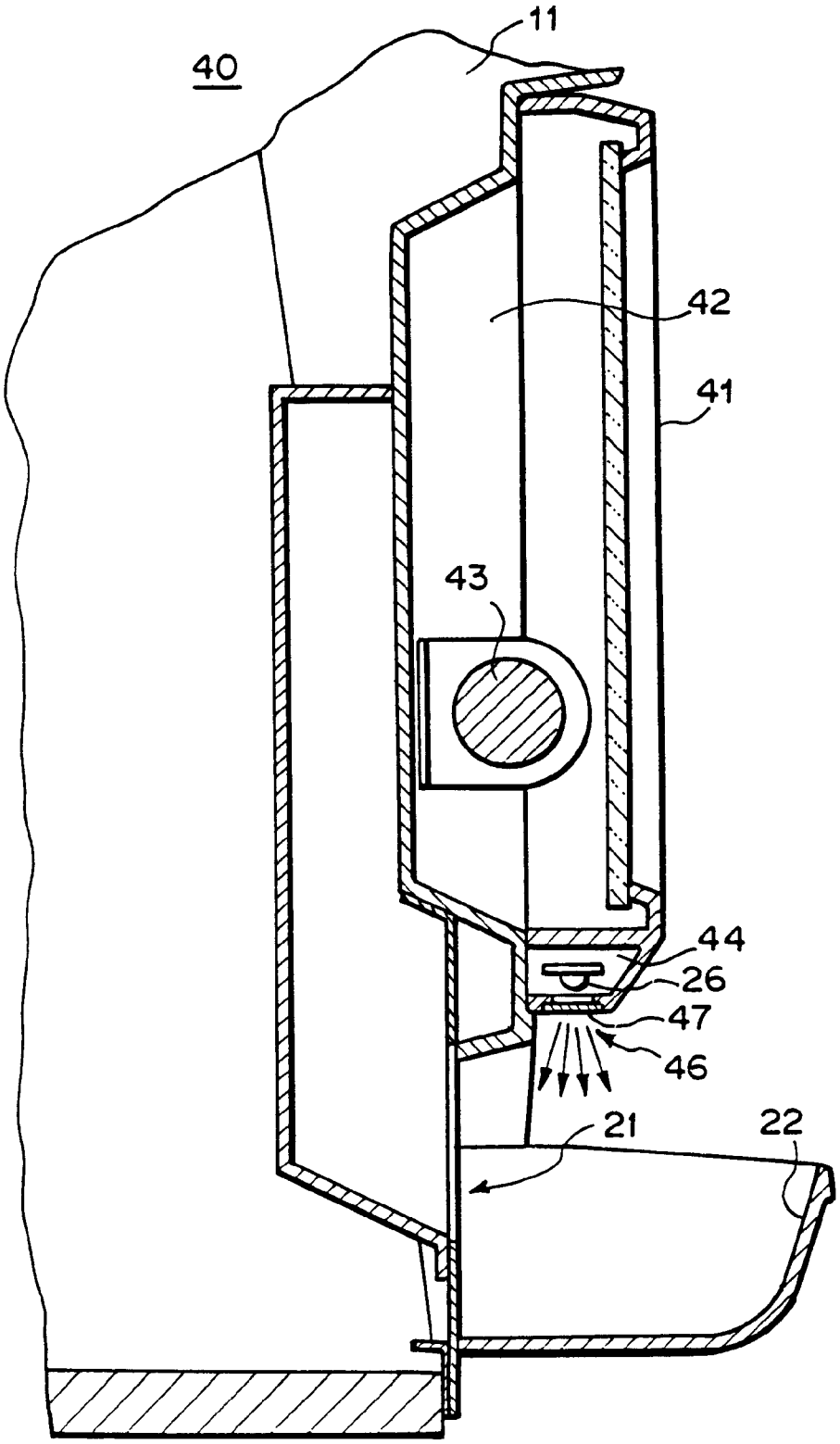
FIG. 4 is a sectional view showing the lower side of the front face of the pachislo machine 40 in accordance with the third embodiment of the present invention as being cut at the center.

FIGS. 3 and 4 show a pachislo machine 40 in accordance with a third embodiment. FIG. 3 shows a perspective view of the lower portion of the pachislo machine 40 in accordance with the third embodiment, whereas FIG. 4 shows the longitudinal sectional view of this portion at the center thereof. In the pachislo machine 40 in accordance with this embodiment, the bactericidal lamp 26 is disposed above the tray 22. The other parts are identical to those of the pachislo machine 10 in accordance with the first embodiment and thus are not explained here.

In these drawings, a wainscot panel 41 displays an appropriate decoration. FIG. 3 shows the state with the wainscot panel 41 being removed. The wainscot panel 41 is fitted into a depression 42, where a fluorescent lamp 43 for illuminating the wainscot panel 41 is disposed.

The portion below the depression 42 and directly above the tray 22 is formed with an elongated accommodation space 44 extending rightward and leftward. The bactericidal lamp 26 is accommodated therein. The lower face portion of the accommodation space 44, i.e., the portion facing the tray 22 from directly thereabove, is an opening portion 46, which is fitted with a normal glass sheet 47.

The normal glass transmits therethrough the ultraviolet rays. The ultraviolet rays emitted from the bactericidal lamp 26 continuously pour over the medals accumulated in the tray 22, thereby sterilizing the medals. It is the tray 22 through which the medals are supplied to a player's hand. As a consequence, the degree of cleanliness is maintained substantially perfectly.

The glass sheet 47 is fitted in order to prevent human hands from accidentally entering therein. If decreases in ultraviolet rays are of concern, a net with such a mesh that no finger would enter may be provided here. Since the temperature of the bactericidal lamp 26 is not so high, it may be simply left open as well.

Here, the accommodation lamp 44 is open downward. As a consequence, the ultraviolet rays would not be made incident on eyes of players and employees. Hence, the ultraviolet rays may be continuously emitted during the operating hours. By way of precaution, a warning label such as the one exemplified in the pachislo machine 10 in accordance with the first embodiment may be stuck to an appropriate position above the tray 22 of the wainscot panel 41.

The present invention is applicable not only to a coin or medal gaming machine such as a rotary drum type gaming machine or the like, but also to a ball-shooting gaming machine such as a pachinko machine or the like.

In the present invention, as explained in the foregoing, light-emitting means for emitting a light beam for sterilizing a gaming medium is disposed in the gaming machine itself at a position where the light beam irradiates a stored gaming medium or a passing gaming medium, the light-emitting means being shielded from eyes of a player.

As a consequence, it is possible to realize a gaming machine with an antibacterial specification in which, unlike the apparatus disclosed in Japanese Unexamined Patent Publication No. 10-57614, the mechanism would not become large and expensive, the cleansing liquid itself is not required to be constantly kept clean, and supply paths and storage devices for gaming media are not needed to be frequently cleaned.

Specifically, when the present invention is applied to a ball-shooting gaming machine, it is not necessary to use specific gaming media such as balls coated with a titanium oxide photocatalyst.

Specifically, when the present invention is applied to a coin or medal gaming machine, one with an antibacterial specification can newly be realized.

Specifically, when the light-emitting means is disposed at a position where the light beam irradiates a gaming medium flowing into storage means within the gaming machine or a gaming medium stored in the storage means, the light-emitting means can be shielded, in a very simple structure, from players' eyes.

Specifically, when the light-emitting means is disposed at a position where the light beam irradiates a gaming medium stored in a tray located outside the gaming machine, a perfect sterilized state can be maintained until the gaming medium is supplied to a player's hand.

When the light-emitting means is disposed within a housing of the gaming machine, and is turned off in synchronization with an opening action of an open/close panel of the housing of the gaming machine when the open/close panel is caused to open, the light beam is securely prevented from doing harm to employees and the like upon maintenance or the like of the gaming machine.

When the light beam is an ultraviolet ray, substantially all the bacteria attached to the gaming medium can be killed.

What is claimed is:

1. A gaming machine comprising light-emitting means for emitting a light beam for sterilizing a gaming medium, said light-emitting means being disposed in said gaming machine at a position where said light beam irradiates a stored gaming medium when stored in a tray through which medals are supplied to a player's hand, wherein said light-emitting means is shielded from eyes of a player.

2. A gaming machine according to claim 1, wherein said light beam is an ultraviolet ray.

3. A gaming machine according to claim 1, wherein said gaming machine is a ball-shooting gaming machine.

4. A gaming machine according to claim 3, wherein said light beam is an ultraviolet ray.

5. A gaming machine according to claim 3, wherein said light-emitting means is disposed at a position where said light beam irradiates a gaming medium flowing into the tray.

6. A gaming machine according to claim 5, wherein said light beam is an ultraviolet ray.

7. A gaming machine according to claim 5, wherein said light-emitting means is disposed within a housing of said gaming machine, and is turned off in synchronization with an opening action of an open/close panel of said housing of said gaming machine when said open/close panel is caused to open.

8. A gaming machine according to claim 1, wherein said gaming machine is a coin or medal gaming machine.

9. A gaming machine according to claim 8, wherein said light beam is an ultraviolet ray.

10. A gaming machine according to claim 1, wherein said light-emitting means is disposed at a position where said light beam irradiates a gaming medium stored in a tray located outside said gaming machine.

11. A gaming machine according to claim 10, wherein said light beam is an ultraviolet ray.

12. A gaming machine according to claim 10, wherein said light-emitting means is disposed within a housing of said gaming machine, and is turned off in synchronization with an opening action of an open/close panel of said housing of said gaming machine when said open/close panel is caused to open.

13. A gaming machine comprising light-emitting means for emitting a light beam for sterilizing a gaming medium, said light-emitting means being disposed in said gaming machine at a position where said light beam irradiates a gaming medium after the medium flows into an insertion slot and before flowing of the medium into a hopper or after flowing of the medium from the hopper and before flowing of the medium through a payout slot, said light-emitting means being shielded from eyes of a player, and being turned off in synchronization with an opening action of an open/close panel of said housing of said gaming machine when said open/close panel is caused to open.

14. A gaming machine according to claim 13, wherein said light beam is an ultraviolet ray.

15. A gaming machine according to claim 13, wherein said gaming machine is a ball-shooting gaming machine.

16. A gaming machine according to claim 15, wherein said light beam is an ultraviolet ray.

17. A gaming machine according to claim 15, wherein said light-emitting means is disposed at a position where said light beam irradiates the gaming medium when it flows into a storage means.

18. A gaming machine according to claim 13, wherein said gaming machine is a coin or a medal gaming machine.

19. A gaming machine according to claim 18, wherein said light beam is an ultraviolet ray.

20. A gaming machine comprising light-emitting means for emitting a light beam for sterilizing a gaming medium, said light-emitting means being disposed in said gaming machine at a position where said light beam irradiates a gaming medium when stored in an internal storage hopper, wherein said light-emitting means is shielded from eyes of a player, and is turned off in synchronization with an opening action of an open/close panel of said housing of said gaming machine when said open/close panel is caused to open.

21. A gaming machine according to claim 20, wherein said light beam is an ultraviolet ray.

22. A gaming machine according to claim 20, wherein said gaming machine is a ball-shooting gaming machine.

23. A gaming machine according to claim 22, wherein said light beam is an ultraviolet ray.

24. A gaming machine according to claim 22, wherein said light-emitting means is disposed at a position wherein said light beam irradiates gaming medium flowing into the hopper.

25. A gaming machine according to claim 20, wherein said gaming machine is a coin or medal gaming machine.

26. A gaming machine according to claim 25, wherein said light beam is an ultraviolet ray.

* * * * *

UNITED STATES PATENT AND TRADEMARK OFFICE

CERTIFICATE OF CORRECTION

PATENT NO. : 6,311,974 B1
DATED : November 6, 2001
INVENTOR(S) : Akira Koga

It is certified that error appears in the above-identified patent and that said Letters Patent is hereby corrected as shown below:

Title page,
In the title delete "GAMING MACHINE WITH STERILIZING LIGHT BEAM" and substitute therefore -- GAMING MACHINE HAVING MEANS FOR STERILIZING A GAMING MEDIUM --.

Signed and Sealed this

Thirtieth Day of April, 2002

*Attest:*

*Attesting Officer*

JAMES E. ROGAN
*Director of the United States Patent and Trademark Office*